US009017044B2

(12) United States Patent
Nakai et al.

(10) Patent No.: US 9,017,044 B2
(45) Date of Patent: Apr. 28, 2015

(54) ELECTROMAGNETIC PUMP

(75) Inventors: Masaya Nakai, Tokoname (JP); Kota Fukao, Anjo (JP); Takahiro Kokubu, Anjo (JP)

(73) Assignee: Aisin AW Co., Ltd., Anjo (JP)

( * ) Notice: Subject to any disclaimer, the term of this patent is extended or adjusted under 35 U.S.C. 154(b) by 532 days.

(21) Appl. No.: 13/370,048

(22) Filed: Feb. 9, 2012

(65) Prior Publication Data

US 2012/0244022 A1 Sep. 27, 2012

(30) Foreign Application Priority Data

Mar. 25, 2011 (JP) ..... 2011-068807

(51) Int. Cl.
*F04B 17/04* (2006.01)

(52) U.S. Cl.
CPC ..... *F04B 17/042* (2013.01); *F04B 17/048* (2013.01)

(58) Field of Classification Search
CPC ..... F04B 17/04; F04B 17/042; F04B 17/044; F04B 17/046
USPC ..... 417/415, 416, 417, 470, 554, 555.1, 417/569, 570
See application file for complete search history.

(56) References Cited

U.S. PATENT DOCUMENTS

| | | | | |
|---|---|---|---|---|
| 2,673,522 | A * | 3/1954 | Dickey | 417/388 |
| 3,556,684 | A * | 1/1971 | Rouquette | 417/307 |
| 4,047,852 | A | 9/1977 | O'Connor et al. | |
| 5,472,323 | A * | 12/1995 | Hirabayashi et al. | 417/417 |
| 5,823,639 | A | 10/1998 | Zinnkann et al. | |
| 6,866,489 | B2 | 3/2005 | Hinz et al. | |
| 8,043,072 | B2 | 10/2011 | Maeda et al. | |

FOREIGN PATENT DOCUMENTS

| | | | |
|---|---|---|---|
| CN | 2883723 | Y | 3/2007 |
| DE | 1653354 | B | 4/1967 |
| DE | 1900093 | B | 1/1969 |
| DE | 9211478 | U1 | 8/1992 |
| DE | 9319462 | U1 | 12/1993 |
| DE | 19743186 | A1 | 1/1999 |
| DE | 102007000071 | A1 | 8/2007 |

(Continued)

OTHER PUBLICATIONS

Apr. 24, 2012 Search Report issued in PCT/JP2012/053065 (with translation).

*Primary Examiner* — Charles Freay
*Assistant Examiner* — Philip Stimpert
(74) *Attorney, Agent, or Firm* — Oliff PLC

(57) ABSTRACT

An electromagnetic pump including a reciprocating piston in a cylinder; an electromagnetic portion that moves the piston forward; a first biasing member that moves the piston backward; a support member that supports the first biasing member and defines a pump chamber together with the cylinder and the piston; an intake valve that is incorporated into the support member, is connected to an intake port and prohibits hydraulic fluid from moving in reverse; and a discharge valve that is connected to a discharge port and prohibits the hydraulic fluid from moving in reverse. The intake valve includes a ball, an opening portion of the intake port, and a second biasing member that presses the ball against the opening portion from a side opposite to a direction in which the hydraulic fluid moves. In the opening member, an inner peripheral surface that receives the ball is formed in a taper shape.

7 Claims, 4 Drawing Sheets

(56) References Cited

FOREIGN PATENT DOCUMENTS

| | | |
|---|---|---|
| EP | 1268248 B1 | 3/2003 |
| JP | U-58-51079 | 4/1983 |
| JP | U-1-115075 | 8/1989 |
| JP | A-9-257140 | 9/1997 |
| JP | A-2010-181010 | 8/2010 |
| JP | A-2011-021593 | 2/2011 |
| WO | WO 2010/146952 A1 | 12/2010 |

* cited by examiner

ELECTROMAGNETIC PUMP

INCORPORATION BY REFERENCE

The disclosure of Japanese Patent Application No. 2011-068807 filed on Mar. 25, 2011 including the specification, drawings and abstract is incorporated herein by reference in its entirety.

BACKGROUND OF THE INVENTION

The present invention relates to an electromagnetic pump that includes: a cylinder; a piston capable of reciprocating in the cylinder; an electromagnetic portion that moves the piston forward; a biasing member that moves the piston backward; a support member that supports the biasing member and defines a pump chamber together with the cylinder and the piston; an intake open-close valve that is incorporated into the support member, and allows a hydraulic fluid to move from an intake port to the pump chamber and prohibits the hydraulic fluid from moving in the reverse direction; and a discharge open-close valve that allows the hydraulic fluid to move from the pump chamber to a discharge port and prohibits the hydraulic fluid from moving in the reverse direction.

DESCRIPTION OF THE RELATED ART

In related art, as this type of electromagnetic pump, an electromagnetic pump has been proposed that includes a cylinder, a piston that defines a pump chamber and reciprocates in the cylinder, a solenoid portion that moves the piston forward, a spring that moves the piston backward, an intake check valve that allows a hydraulic oil to flow from an intake port to the pump chamber and prohibits the hydraulic oil from flowing in the reverse direction, and a discharge check valve that allows the hydraulic oil to flow from the pump chamber to a discharge port and prohibits the hydraulic oil from flowing in the reverse direction (see Japanese Patent Application Publication No. JP-A-2011-21593, for example). In this electromagnetic pump, the intake check valve and the discharge check valve are accommodated in the cylinder. The intake check valve includes a ball, a main body, a spring, and a spring receiver. The main body is hollow cylinder shaped, and the ball is accommodated in the main body. The main body is also formed with a center hole at an axial center thereof. The center hole, serving as an opening of the intake port, has an inner diameter smaller than an outer diameter of the ball, and allows communication between the intake port and the pump chamber. The spring biases the ball against the opening of the intake port in the reverse direction from a direction in which the hydraulic oil flows from the intake port. The spring receiver receives this spring.

SUMMARY OF THE INVENTION

In the electromagnetic pump as described above, if the balls in the intake check valve and the discharge check valve are not properly positioned (centered), leakage of the hydraulic oil occurs, resulting in the possibility that the electromagnetic pump cannot sufficiently exert its performance. In a type of electromagnetic pump into which the check valve is built, in particular, the size of the check valve is reduced from necessity to dispose the check valve within a limited space in the cylinder. Therefore, it is desirable that the structure for positioning the ball be achieved by simpler processing.

It is a main object of the present invention to more accurately position a ball in an open-close valve with a simple structure so as to allow an electromagnetic pump to sufficiently exert its performance.

The electromagnetic pump according to the present invention employs the following means in order to achieve the main object described above.

An electromagnetic pump according to a first aspect of the present invention includes: a cylinder; a piston capable of reciprocating in the cylinder; an electromagnetic portion that moves the piston forward; a first biasing member that moves the piston backward; a support member that supports the first biasing member and defines a pump chamber together with the cylinder and the piston; an intake open-close valve that is incorporated into the support member, and allows a hydraulic fluid to move from an intake port to the pump chamber and prohibits the hydraulic fluid from moving in a reverse direction; and a discharge open-close valve that allows the hydraulic fluid to move from the pump chamber to a discharge port and prohibits the hydraulic fluid from moving in the reverse direction. In the electromagnetic pump, the intake open-close valve includes a ball, an opening member in which an opening portion of the intake port is formed, and a second biasing member that presses the ball against the opening portion from a side opposite to a direction in which the hydraulic fluid moves, and in the opening member, an inner peripheral surface of the opening portion that receives the ball is formed in a taper shape.

The electromagnetic pump according to the first aspect of the present invention that includes: the cylinder; the piston capable of reciprocating in the cylinder; the electromagnetic portion that moves the piston forward; the first biasing member that moves the piston backward; the support member that supports the first biasing member and defines the pump chamber together with the cylinder and the piston; the intake open-close valve that is incorporated into the support member, and allows the hydraulic fluid to move from the intake port to the pump chamber and prohibits the hydraulic fluid from moving in the reverse direction; and the discharge open-close valve that allows the hydraulic fluid to move from the pump chamber to the discharge port and prohibits the hydraulic fluid from moving in the reverse direction. In the electromagnetic pump thus configured, the intake open-close valve includes the ball, the opening member in which the opening portion of the intake port is formed, and the second biasing member that presses the ball against the opening portion from the side opposite to the direction in which the hydraulic fluid moves. Further, in the opening member, the inner peripheral surface of the opening portion that receives the ball is formed in a taper shape. With this configuration, the ball is received on the taper-shaped inner peripheral surface of the opening member, and thus the ball can be positioned at a proper position, whereby it is possible to more reliably suppress a leakage of the hydraulic fluid from the intake open-close valve. Consequently, the electromagnetic pump can sufficiently exert its performance. In addition, this configuration only requires formation of the taper-shaped inner peripheral surface, and it is thus possible to suppress a leakage of the hydraulic fluid from the intake open-close valve by performing a simple processing.

In the electromagnetic pump according to a second aspect of the present invention, the support member may be formed with a bottomed hollow portion including an opening portion that opens toward a side of the intake port, and a communication hole that is formed on a bottom of the support member and communicates with the pump chamber, and in the intake open-close valve, the second biasing member, the ball, and the opening member may be incorporated into the support member in this order from the opening portion of the hollow portion. The electromagnetic pump according to a third aspect of the present invention may further include a cover member that covers an end surface of the cylinder with the piston, the first biasing member, the support member, and the intake open-close valve incorporated into the cylinder in this order. In the electromagnetic pump, the opening member may include a cylinder-shaped cylindrical portion having an inner peripheral surface formed in the taper shape and an outer peripheral surface that is fitted to an inner peripheral surface of the hollow portion of the support member, and a flange portion that radially extends from an edge of the cylindrical portion and has a surface that faces in the direction in which the hydraulic fluid moves and is brought in contact with an end surface of the support member on a side of the opening portion. A filter may be disposed on a surface of the flange portion facing opposite to the direction in which the hydraulic fluid moves, and the cover member may be attached such that the filter is interposed between the cover member and the flange portion. This makes it possible to make assembly of the electromagnetic pump easier. Further, in the electromagnetic pump according to a fourth aspect of the present invention, the flange portion may include a recessed portion formed by recessing a predetermined range of the flange portion, wherein the predetermined range of the flange portion includes the opening portion of the opening member formed on the surface facing opposite to the direction in which the hydraulic fluid moves, and the filter may be disposed in the recessed portion. This makes it possible to more easily dispose the filter at a proper position.

DETAILED DESCRIPTION OF THE EMBODIMENTS

Next, an embodiment of the invention will be described below.

Figure 1:
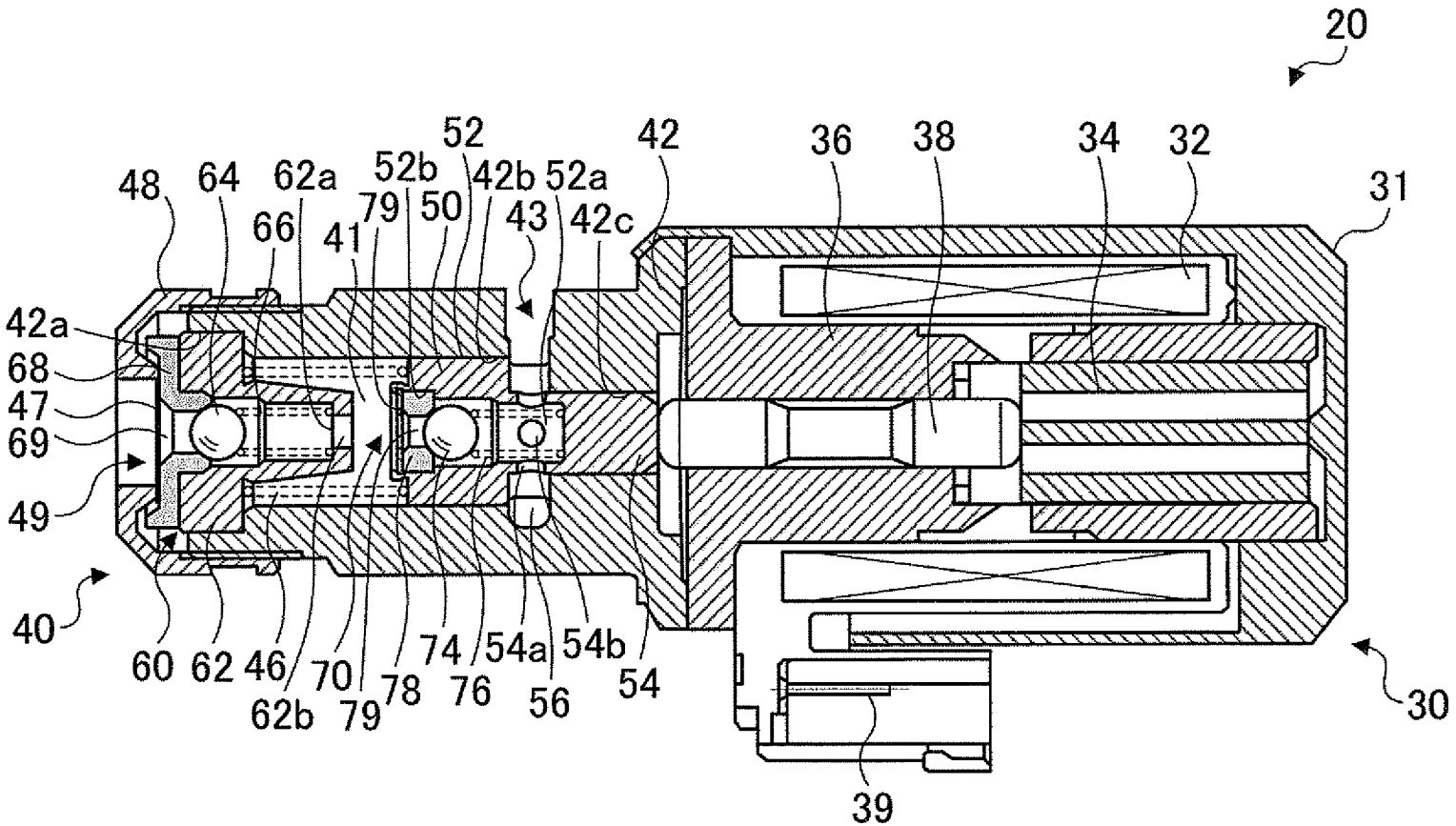
FIG. 1 is a block diagram schematically showing a configuration of an electromagnetic pump 20 according to an embodiment of the present invention.

FIG. 1 is a block diagram schematically showing a configuration of an electromagnetic pump 20 according to an embodiment of the present invention. As shown in the drawing, the electromagnetic pump 20 according to the embodiment is configured as a piston pump in which a piston 50 reciprocates so as to pressure-feed a hydraulic oil. The electromagnetic pump 20 includes a solenoid portion 30 that generates an electromagnetic force, and a pump portion 40 that operates on the electromagnetic force generated by the solenoid portion 30. The electromagnetic pump 20 is incorporated into a valve body as part of a hydraulic circuit for applying and releasing clutches and brakes of an automatic transmission mounted in a vehicle, for example.

The solenoid portion 30 includes a case 31 that is a bottomed cylinder member in which an electromagnetic coil 32, a plunger 34 serving as a moving element, and a core 36 serving as a stator are disposed. When a current is applied to the electromagnetic coil 32, a magnetic circuit is formed in which a magnetic flux circulates around the case 31, the plunger 34, and the core 36. The plunger 34 is attracted due to the magnetic circuit thus formed and pushes forward a shaft 38 that abuts on a distal end portion of the plunger 34.

The pump portion 40 includes a cylinder 42, the piston 50, a spring 46, an intake check valve 60, a discharge check valve 70, a strainer 47, and a cylinder cover 48. The cylinder 42 is hollow cylinder shaped and bonded to the solenoid portion 30. The piston 50 is slidably disposed inside the cylinder 42 and a base end surface of the piston 50 coaxially abuts on a distal end portion of the shaft 38 of the solenoid portion 30. The spring 46 abuts on a distal end surface of the piston 50 and applies a biasing force to the piston 50 in a direction opposite to a direction in which the electromagnetic force from the solenoid portion 30 acts. The intake check valve 60 supports the spring 46 from a side opposite to the distal end surface of the piston 50. The intake check valve 60 allows the hydraulic oil to flow toward the pump chamber 41 so as to be suctioned into the pump chamber 41, and prohibits the hydraulic oil from flowing in the reverse direction. The discharge check valve 70 is built into the piston 50. The discharge check valve 70 allows the hydraulic oil to flow in a direction in which the hydraulic oil is discharged from the pump chamber 41, and prohibits the hydraulic oil from flowing in the reverse direction. The strainer 47 is disposed on an upstream side of the intake check valve 60 and traps foreign matter contained in the hydraulic oil to be suctioned into the pump chamber 41. The piston 50, the discharge check valve 70, the spring 46, the intake check valve 60, and the strainer 47 are incorporated into the cylinder 42 in this order from an opening portion 42*a* formed on a side opposite to the solenoid portion 30, and the cylinder cover 48 covers the opening portion 42*a* with these components arranged in the cylinder 42. Spiral grooves are respectively formed circumferentially on an inner peripheral surface of the cylinder cover 48 and on an outer peripheral surface of the opening portion 42*a* of the cylinder 42. The cylinder cover 48 is attached to the opening portion 42*a* of the cylinder 42 by fitting and screwing the cylinder cover 48 on the opening portion 42*a* of the cylinder 42. Further, in the pump portion 40, an intake port 49 is formed in the cylinder cover 48 at an axial center thereof such that the hydraulic oil is suctioned through the intake port 49, and a discharge port 43 is formed to open in a side surface of the cylinder 42 such that the suctioned hydraulic oil is discharged through the discharge port 43.

The piston 50 is formed of a cylindrically shaped piston body 52 and a cylindrically shaped shaft portion 54 that has a smaller outer diameter than that of the piston body 52 and whose end surface abuts on the distal end portion of the shaft 38 of the solenoid portion 30. The piston 50 reciprocates in the cylinder 42 in association with the movement of the shaft 38 of the solenoid portion 30. A bottomed hollow portion 52*a* that is cylindrically shaped is formed in the piston 50 at an axial center thereof such that the discharge check valve 70 can be accommodated in the hollow portion 52*a*. The hollow portion 52*a* of the piston 50 extends from the distal end surface of the piston 50 toward a middle portion inside the shaft portion 54, while extending through the inside of the piston body 52. In addition, the shaft portion 54 is formed with two through holes 54*a*, 54*b* extending in a radial direction in a manner such that the through holes 54*a*, 54*b* intersect with each other at an angle of 90 degrees. The discharge port 43 is formed in the cylinder 42 to reach the circumference of the shaft portion 54, and the hollow portion 52*a* of the piston 50 communicates with the discharge port 43 through the two through holes 54*a*, 54*b*.

Figure 2:
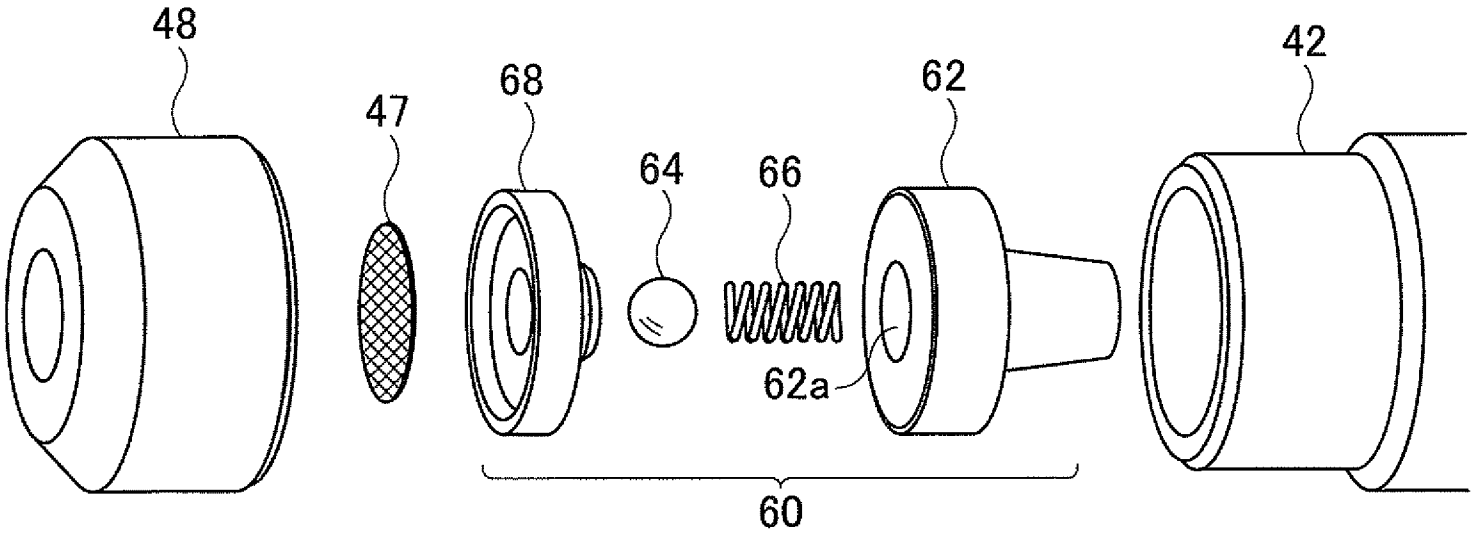
FIG. 2 is an exploded perspective view showing a cylinder 42, an intake check valve 60, and a cylinder cover 48.

The intake check valve 60 includes a valve main body 62, a ball 64, a spring 66, and a plug 68. The valve main body 62 is inserted into the cylinder 42 through the opening portion 42*a* and fitted to an inner peripheral surface of the opening portion 42*a*. A bottomed hollow portion 62*a* is formed in the intake check valve 60, and a center hole 62*b* is formed in the bottom of the hollow portion 62*a* at an axial center thereof such that the hollow portion 62*a* communicates with the pump chamber 41 through the center hole 62*b*. The spring 66 applies a biasing force to the ball 64. The plug 68 is inserted into the hollow portion 62*a* and fitted to an inner peripheral surface of the hollow portion 62*a* with the ball 64 and the spring 66 incorporated in the hollow portion 62*a* of the valve main body 62. FIG. 2 is an exploded perspective view showing the cylinder 42, the intake check valve 60, and the cylinder cover 48. As shown in the drawing, the intake check valve 60 is formed by assembling the spring 66, the ball 64, and the plug 68 to the hollow portion 62*a* of the valve main body 62 in this order.

Figure 3:
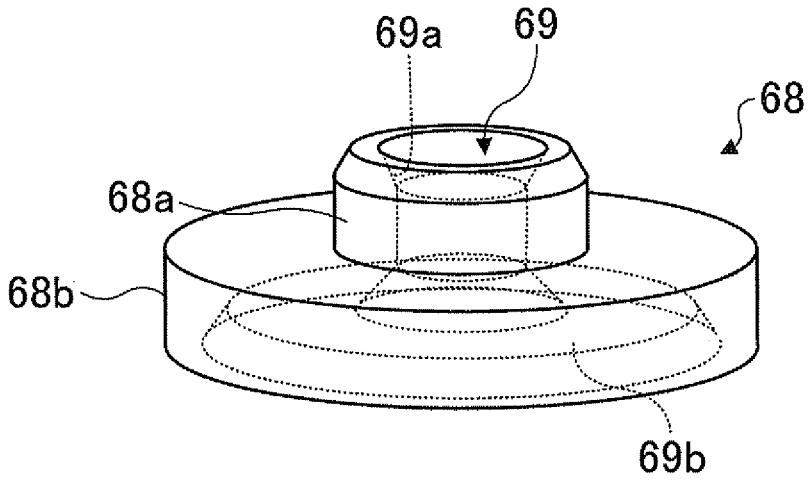
FIG. 3 is a perspective view showing a plug 68 as seen from a pump chamber 41 side.
Figure 4:
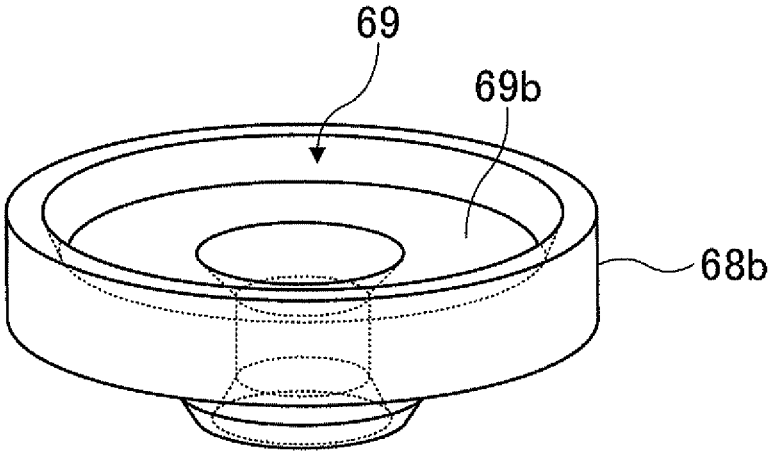
FIG. 4 is a perspective view showing the plug 68 as seen from an intake port 49 side.
Figure 5:
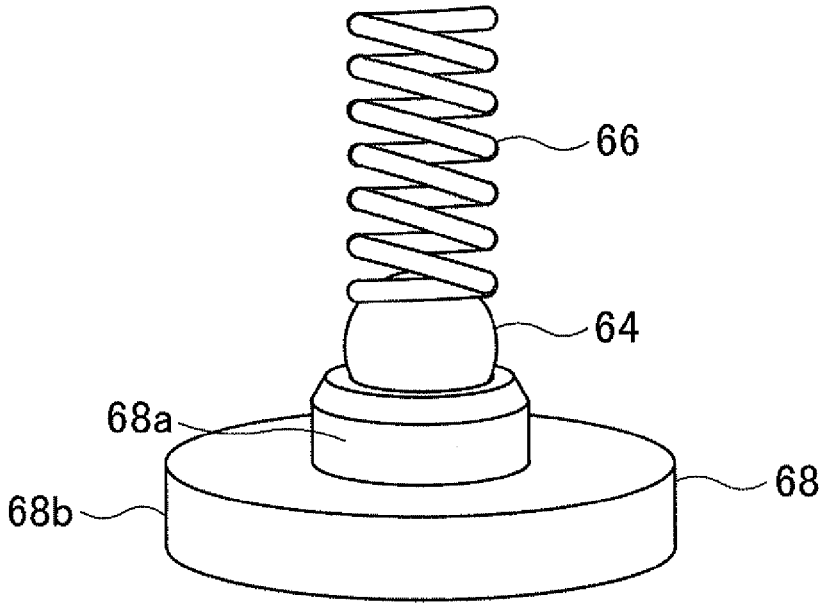
FIG. 5 is an explanatory view illustrating a state in which a ball 64 is pressed against the plug 68 by a spring 66.
Figure 6:
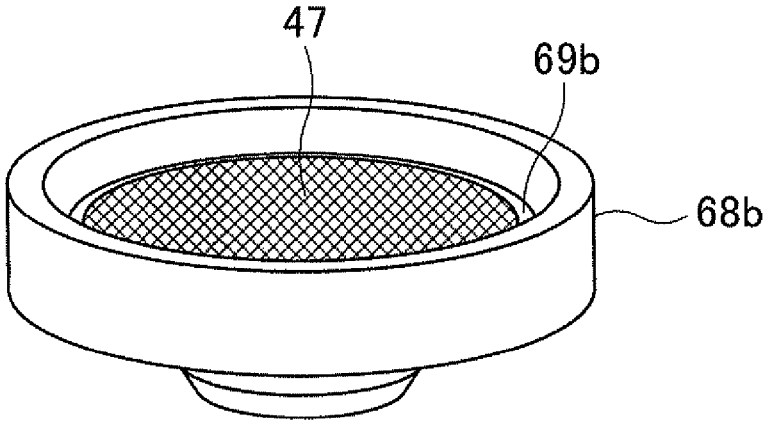
FIG. 6 is an explanatory view showing a state in which a strainer 47 is provided in the plug 68.

FIG. 3 is a perspective view showing the plug 68 as seen from the pump chamber 41 side. FIG. 4 is a perspective view showing the plug 68 as seen from the intake port 49 side. FIG. 5 is an explanatory view illustrating a state in which the ball 64 is pressed against the plug 68 by the spring 66. FIG. 6 is an explanatory view showing a state in which the strainer 47 is provided in the plug 68. As shown in FIGS. 3 and 5, the plug 68 includes a cylindrical portion 68*a* and a base portion 68*b*. The ball 64 is received at an edge of the cylindrical portion 68*a* on one side. The base portion 68*b* is formed in a flange shape in which the base portion 68*b* radially extends from an edge of the cylindrical portion 68*a* on the other side. A center hole 69 having an inner diameter smaller than an outer diameter of the ball 64 is formed at an axial center of the plug 68. A taper surface 69*a* is formed in a portion of the cylindrical portion 68*a* that is brought in contact with the ball 64. The taper surface 69*a* is formed such that an inner diameter of the taper surface 69*a* gradually increases from the bottom toward the top in the drawing. The ball 64 is positioned (centered) by the taper surface 69*a*. Therefore, even if a small dimensional error or assembling error occurs in the intake check valve 60, displacement of the ball 64 is not caused. Further, the plug 68 is formed with a circular recessed portion 69*b* that includes the center hole 69 formed on the back surface of the base portion 68*b*. The strainer 47 is disposed in this recessed portion 69*b*. As shown in FIG. 1, when the cylinder cover 48 is attached to the cylinder 42 with the intake check valve 60 and the strainer 47 disposed in the cylinder 42, a peripheral edge of the strainer 47 is interposed between the cylinder cover 48 and the intake check valve 60.

When a differential pressure (P1-P2), which is a difference between a pressure P1 on the intake port 49 side and a pressure P2 on the pump chamber 41 side, is equal to or larger than a predetermined pressure that overcomes the biasing force of the spring 66, the ball 64 is separated from the center hole 69 of the plug 68 as the spring 66 contracts, which opens the intake check valve 60. When the differential pressure (P1-P2) described above is smaller than the predetermined pressure, the ball 64 is pressed against the center hole 69 of the plug 68 and closes the center hole 69 as the spring 66 expands, which closes the intake check valve 60.

The discharge check valve 70 includes a ball 74, a spring 76, and a plug 78. The spring 76 applies a biasing force to the ball 74. The plug 78 serves as a ring-shaped member that includes a center hole 79 having an inner diameter smaller than an outer diameter of the ball 74. The spring 76, the ball 74, and the plug 78 are incorporated in the hollow portion 52*a* of the piston 50 in this order from an opening portion 52*b*, and are fastened by a snap ring 79.

When a differential pressure (P2-P3), which is a difference between the pressure P2 on the pump chamber 41 side and a pressure P3 on the discharge port 43 side, is equal to or larger than a predetermined pressure that overcomes the biasing force of the spring 76, the ball 74 is separated from a center hole 79 of the plug 78 as the spring 76 contracts, which opens the discharge check valve 70. When the differential pressure (P2-P3) described above is smaller than the predetermined pressure, the ball 74 is pressed against the center hole 79 of the plug 78 and closes the center hole 79 as the spring 76 expands, which closes the discharge check valve 70.

In the cylinder 42, the pump chamber 41 is formed by a space surrounded by an inner wall 42*b* on which the piston body 52 slides, a surface of the piston body 52 on the spring 46 side, and a surface of the valve main body 62 of the intake check valve 60 on the spring 46 side. When the piston 50 is moved by the biasing force of the spring 46, the intake check valve 60 opens and the discharge check valve 70 closes so as to suction the hydraulic oil into the pump chamber 41 through the intake port 49, as the volume in the pump chamber 41 increases. When the piston 50 is moved by the electromagnetic force of the solenoid portion 30, the intake check valve 60 closes and the discharge check valve 70 opens, as the volume in the pump chamber 41 is reduced. This causes the suctioned hydraulic oil to be discharged through the discharge port 43.

Further, in the cylinder 42, the inner wall 42*b* on which the piston body 52 slides is stepped from an inner wall 42*c* on which the shaft portion 54 slides, and the discharge port 43 is formed in such a stepped portion. The stepped portion provides a space surrounded by an annular surface of the stepped portion between the piston body 52 and the shaft portion 54 and an outer peripheral surface of the shaft portion 54. The space is formed on the opposite side of the piston body 52 from the pump chamber 41. The volume of this space is reduced when the volume of the pump chamber 41 increases, and increases when the volume of the pump chamber 41 is reduced. At this time, a change in the volume of the space becomes smaller than a change in the volume of the pump chamber 41, because an area of the piston body 52 (pressure-receiving area) that receives the pressure from the pump chamber 41 side is larger than an area of the piston body 52 (pressure-receiving area) that receives the pressure from the discharge port 43 side. Accordingly, the space functions as a second pump chamber 56. In other words, when the piston 50 is moved by the electromagnetic force of the solenoid portion 30, the hydraulic oil in an amount corresponding to a difference between a reduction in the volume of the pump chamber 41 and an increase in the volume of the second pump chamber 56 is supplied from the pump chamber 41 to the second pump chamber 56 through the discharge check valve 70, and then discharged through the discharge port 43. When the piston 50 is moved by the biasing force of the spring 46, the hydraulic oil in an amount corresponding to a reduction in the volume of the second pump chamber 56 is discharged from the second pump chamber 56 through the discharge port 43, while the hydraulic oil in an amount corresponding to an increase in the volume of the pump chamber 41 is suctioned into the pump chamber 41 from the intake port 49 through the intake check valve 60. Accordingly, the hydraulic oil is discharged from the discharge port 43 twice for one reciprocating movement of the piston 50, which reduces discharging unevenness and improves discharge performance.

In the electromagnetic pump 20 according to the embodiment described above, the plug 68 that supports the ball 64 of the intake check valve 60 is formed to include the center hole 69 that is formed at the axial center of the plug 68 and has the inner diameter smaller than the outer diameter of the ball 64. In addition, the plug 68 is formed of the cylindrical portion 68*a* that receives the ball 64 at the edge on one side and the base portion 68*b* formed in a flange shape in which the base portion 68*b* radially extends from the edge of the cylindrical portion 68*a* on the other side. The taper surface 69*a* is formed in a portion of the cylindrical portion 68*a* that is brought in contact with the ball 64. This configuration makes it possible to position (center) the ball 64 by the taper surface 69*a*. Consequently, even if a small dimensional error or assembling error occurs in the intake check valve 60, displacement of the ball 64 is not caused, which suppresses a leakage of the hydraulic oil from the intake check valve 60. Moreover, the strainer 47 is disposed in the circular recessed portion 69*b* that includes the center hole 69 formed on the back surface of the base portion 68*b*, and the peripheral edge of the strainer 47 is interposed between the cylinder cover 48 and the intake check valve 60. This makes it possible to more easily and accurately position the strainer 47. The positioning described herein can be achieved simply by forming the taper surface 69*a* and the recessed portion 69*b* in the plug 68, whereby processing thereof can be easily performed.

In the electromagnetic pump 20 according to the embodiment, the discharge check valve 70 is built into the piston 50. However, the discharge check valve 70 need not be built into the piston 50, for example, the discharge check valve 70 may be incorporated into a valve body outside of the cylinder 42.

In the electromagnetic pump 20 according to the embodiment, the strainer 47 is disposed in the circular recessed portion 69*b* that includes the center hole 69 formed on the back surface of the base portion 68*b*, and the peripheral edge of the strainer 47 is interposed between the cylinder cover 48 and the intake check valve 60. However, the base portion 68*b* may include a flat surface in place of the recessed portion 69*b*, and the strainer 47 may be placed on the flat surface. Further, the strainer 47 may be disposed at a position other than the position between the intake check valve 60 and the cylinder cover 48.

The electromagnetic pump 20 according to the embodiment is configured as a type of electromagnetic pump that discharges the hydraulic oil through the discharge port 43 twice for one reciprocating movement of the piston 50. However, the present invention is not limited to this. The electromagnetic pump 20 may be any type of electromagnetic pumps as long as a hydraulic fluid can be discharged as the piston reciprocates. Examples of the electromagnetic pump 20 include a pump that suctions the hydraulic oil through the intake port into the pump chamber when the piston is moved forward by the electromagnetic force from the solenoid portion and discharges the hydraulic oil in the pump chamber through the discharge port when the piston is moved backward by the biasing force of the spring, and a pump that suctions the hydraulic oil through the intake port into the pump chamber when the piston is moved backward by the biasing force of the spring and discharges the hydraulic oil in the pump chamber through the discharge port when the piston is moved forward by the electromagnetic force of the solenoid portion.

In the embodiment, the electromagnetic pump 20 is used for supplying a hydraulic pressure so as to apply and release clutches and brakes of an automatic transmission mounted in a vehicle. However, the present invention is not limited to this, and may be applied to any systems, for example, a system that transfers fuel or a system that transfers lubricating fluid.

Here, a correspondence relation between the main elements of the embodiment and the main elements of the invention described in the Summary of the Invention will be described. In the embodiment, the cylinder 42 may function as a "cylinder"; the piston 50 may function as a "piston"; the solenoid portion 30 may function as to an "electromagnetic portion"; the spring 46 may function as to a "biasing member"; the valve main body 62 may function as a "support member"; the ball 64, the spring 66, and the plug 68 that form the intake check valve 60 may function as an "intake open-close valve"; and the discharge check valve 70 may function as a "discharge open-close valve". Further, the ball 64 may function as a "ball", the spring 66 may function as a "spring", and the plug 68 may function as an "opening member". Moreover, the cylinder cover 48 may function as a "cover member", the cylindrical portion 68*a* of the plug 68 may function as a "cylinder portion", the base portion 68*b* may function as a "flange portion", and the strainer 47 may function as a "filter". It should be noted that the correspondence relation between the main elements of the embodiment and the main elements of the invention described in the Summary of the Invention does not limit the elements of the invention described in the Summary of the Invention, because the embodiment is only an example for giving a specific description of an embodiment of the invention explained in the Summary of the Invention. In other words, how the invention described in the Summary of the Invention is interpreted should be based on the description in the Summary of the Invention, and the embodiment is only a specific example of the invention described in the Summary of the Invention.

An embodiment of the present invention has been described above. However, the present invention is not particularly limited to such an example, and may obviously be carried out in various embodiments without departing from the scope of the present invention.

The present invention can be used in, for example, a manufacturing industry of an electromagnetic pump.

What is claimed is:

1. An electromagnetic pump comprising:

a cylinder;

a piston capable of reciprocating in the cylinder;

an electromagnetic portion that moves the piston forward;

a first biasing member that moves the piston backward;

a support member that supports the first biasing member and defines a pump chamber together with the cylinder and the piston;

an intake open-close valve that is incorporated into the support member, and allows a hydraulic fluid to move from an intake port to the pump chamber and prohibits the hydraulic fluid from moving in a reverse direction; and a discharge open-close valve that allows the hydraulic fluid to move from the pump chamber to a discharge port and prohibits the hydraulic fluid from moving in the reverse direction, and a cover member that covers an end surface of the cylinder, the cover member covering the end surface in a state where the piston, the first biasing member, the support member and the intake open-close valve are incorporated into the cylinder from a side of the end surface in this order, wherein:

the intake open-close valve includes a ball, an opening member in which an opening portion of the intake port is formed, and a second biasing member that presses the ball against the opening portion from a side opposite to a direction in which the hydraulic fluid moves, the opening member includes (i) a cylinder-shaped cylindrical portion having an inner peripheral surface of the opening portion that receives the ball formed in a taper shape, and (ii) a flange portion that radially extends from an edge of the cylindrical portion and is in contact with an end surface of the support member on a side of the opening portion, and the cylinder has a stepped portion which contacts with the support member, and the support member and the intake open-close valve are fastened by the stepped portion of the cylinder and the cover member.

2. The electromagnetic pump according to claim 1, wherein the support member is formed with a bottomed hollow portion including an opening portion that opens toward a side of the intake port, and a communication hole that is formed on a bottom of the support member and communicates with the pump chamber, and in the intake open-close valve, the second biasing member, the ball, and the opening member are incorporated into the support member in this order from the opening portion of the hollow portion.

3. The electromagnetic pump according to claim 2, wherein the cylinder-shaped cylindrical portion has an outer peripheral surface that is fitted to an inner peripheral surface of the hollow portion of the support member, and the flange portion that radially extends from the edge of the cylindrical portion has a surface that faces in the direction in which the hydraulic fluid moves and is in contact with the end surface of the support member on the side of the opening portion, a filter is disposed on a surface of the flange portion facing opposite to the direction in which the hydraulic fluid moves, and the cover member is attached such that the filter is interposed between the cover member and the flange portion.

4. The electromagnetic pump according to claim 3, wherein the flange portion includes a recessed portion formed by recessing a predetermined range of the flange portion, wherein the predetermined range of the flange portion includes the opening portion of the opening member formed on the surface facing opposite to the direction in which the hydraulic fluid moves, and the filter is disposed in the recessed portion.

5. An electromagnetic pump comprising:

a cylinder;

a piston capable of reciprocating in the cylinder;

an electromagnetic portion that moves the piston forward;

a first biasing member that moves the piston backward;

a support member that supports the first biasing member and defines a pump chamber together with the cylinder and the piston;

an intake open-close valve that is incorporated into the support member, and allows a hydraulic fluid to move from an intake port to the pump chamber and prohibits the hydraulic fluid from moving in a reverse direction;

a discharge open-close valve that allows the hydraulic fluid to move from the pump chamber to a discharge port and prohibits the hydraulic fluid from moving in the reverse direction, and a cover member that covers an end surface of the cylinder with the piston, the first biasing member, the support member, and the intake open-close valve incorporated into the cylinder in this order, wherein:

the intake open-close valve includes a ball, an opening member in which an opening portion of the intake port is formed, and a second biasing member that presses the ball against the opening portion from a side opposite to a direction in which the hydraulic fluid moves, in the opening member, an inner peripheral surface of the opening portion that receives the ball is formed in a taper shape, the opening member includes a cylinder-shaped cylindrical portion having an inner peripheral surface formed in the taper shape and an outer peripheral surface that is fitted to an inner peripheral surface of the hollow portion of the support member, and a flange portion that radially extends from an edge of the cylindrical portion and has a surface that faces in the direction in which the hydraulic fluid moves and is brought in contact with an end surface of the support member on a side of the opening portion, a filter is disposed on a surface of the flange portion facing opposite to the direction in which the hydraulic fluid moves, and the cover member is attached such that the filter is interposed between the cover member and the flange portion.

6. The electromagnetic pump according to claim 5, wherein the flange portion includes a recessed portion formed by recessing a predetermined range of the flange portion, wherein the predetermined range of the flange portion includes the opening portion of the opening member formed on the surface facing opposite to the direction in which the hydraulic fluid moves, and the filter is disposed in the recessed portion.

7. The electromagnetic pump according to claim 5, wherein the support member is formed with a bottomed hollow portion including an opening portion that opens toward a side of the intake port, and a communication hole that is formed on a bottom of the support member and communicates with the pump chamber, and in the intake open-close valve, the second biasing member, the ball, and the opening member are incorporated into the support member in this order from the opening portion of the hollow portion.

* * * * *